US006899506B2

(12) United States Patent
Nilsson et al.

(10) Patent No.: US 6,899,506 B2
(45) Date of Patent: May 31, 2005

(54) CONVEYOR AND METHOD FOR MOVING BOOKLETS

(75) Inventors: Göran Nilsson, Bålsta (SE); Joakim Jillehed, Stockholm (SE); Lars Lundström, Stockholm (SE)

(73) Assignee: Bindomatic AB, Stockholm (SE)

( * ) Notice: Subject to any disclaimer, the term of this patent is extended or adjusted under 35 U.S.C. 154(b) by 0 days.

(21) Appl. No.: 10/258,983

(22) PCT Filed: May 18, 2001

(86) PCT No.: PCT/SE01/01120

§ 371 (c)(1),
(2), (4) Date: Oct. 30, 2002

(87) PCT Pub. No.: WO02/04225

PCT Pub. Date: Jan. 17, 2002

(65) Prior Publication Data

US 2003/0106773 A1 Jun. 12, 2003

(30) Foreign Application Priority Data

May 18, 2000 (SE) ..... 0001841

(51) Int. Cl.[7] ..... B42C 9/00

(52) U.S. Cl. ..... 412/37; 412/8; 198/470.1; 198/803.8

(58) Field of Search ..... 198/470.1, 803.8; 412/8, 900, 37

(56) References Cited

U.S. PATENT DOCUMENTS 3,104,756 A * 9/1963 Walker ..... 198/470.1
3,146,127 A * 8/1964 Geoffroy et al. ..... 118/58
3,717,366 A * 2/1973 Decker ..... 412/8
4,801,132 A * 1/1989 Reist ..... 270/52.22
5,066,183 A * 11/1991 Tholerus ..... 412/4
5,102,277 A * 4/1992 Tholerus ..... 412/8
5,667,211 A * 9/1997 Reist ..... 270/52.16

* cited by examiner

*Primary Examiner*—Joe Dillon, Jr.
(74) *Attorney, Agent, or Firm*—Cooper & Dunham LLP

(57) ABSTRACT

The present invention relates to a conveyor that includes at least one dogging device. The dogging device includes a plurality of dogging yokes (105). These are arranged to move commonly after one another and in mutually spaced relationship in a transport direction. The conveyor is constructed to move booklets (1) piece-wise in the transport direction, by virtue of a pair of adjacent dogging yokes (105) being arranged to straddle a side edge of a booklet (1) with clearance in the transport direction. The object of the invention is to avoid an oblique or inclined orientation of the booklets between the dogging yokes. According to the invention, there is provided a support device (106) which acts between two adjacent dogging yokes (105) which at least partially bridge the clearance when one side edge of a booklet (1) is straddled by the adjacent dogging yokes (105). The invention also relates to a method for moving booklets, wherein one side edge of a booklet (1) is straddled by dogging yokes (105) with clearance in the transport direction. The clearance is reduced subsequent to straddling of a booklet.

16 Claims, 6 Drawing Sheets

Fig. 1
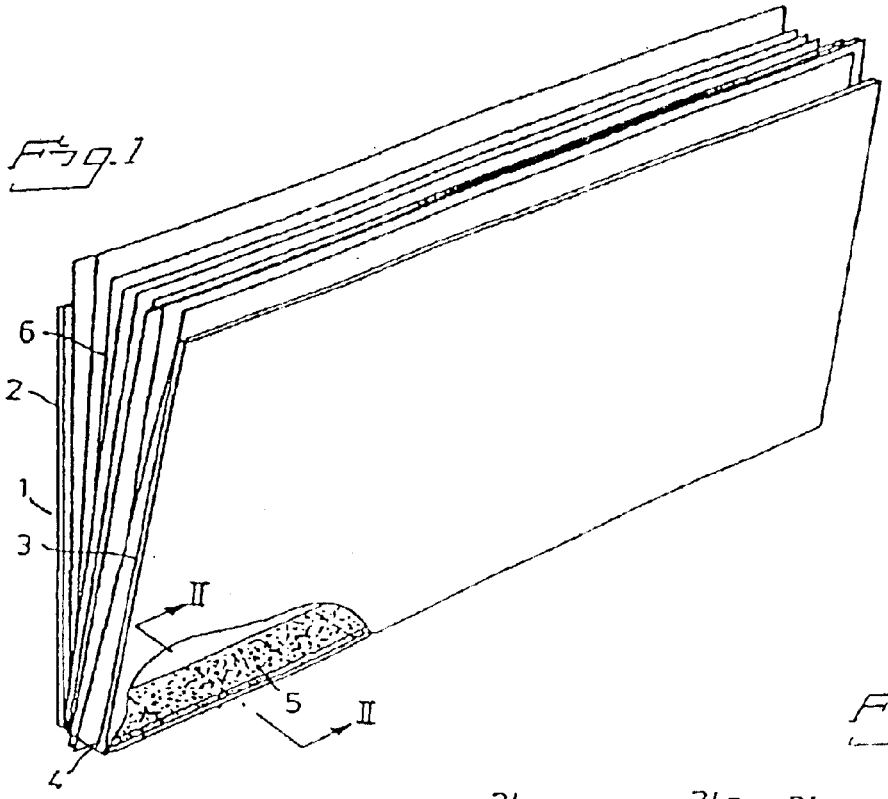
Fig. 4
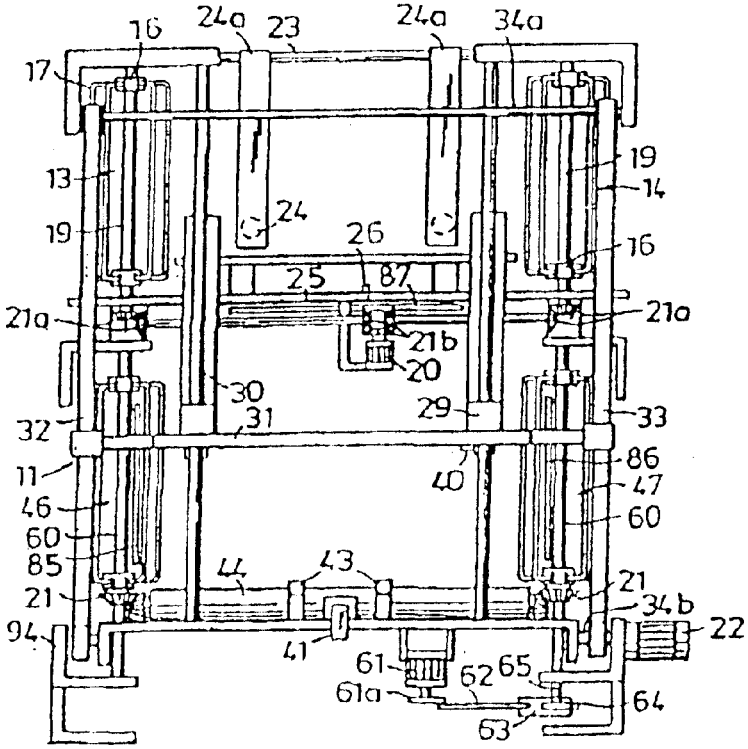
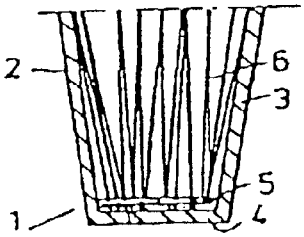
Fig. 2

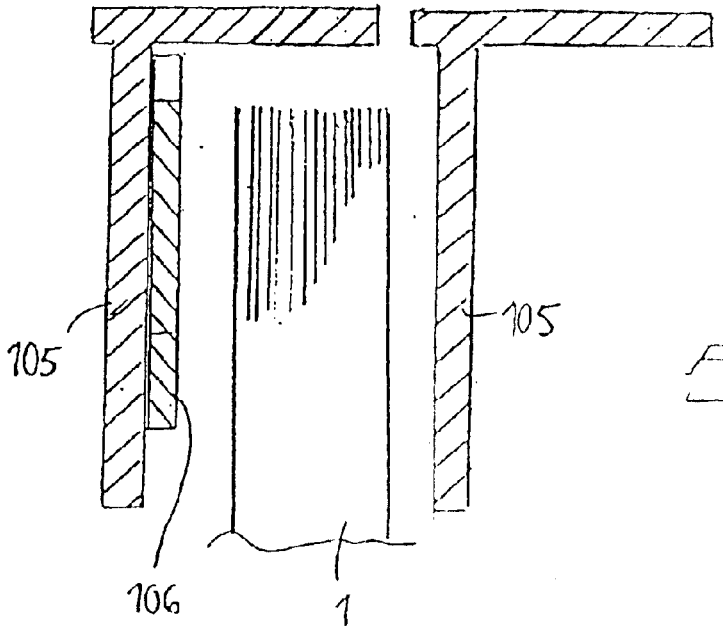
Fig.16
Fig.17
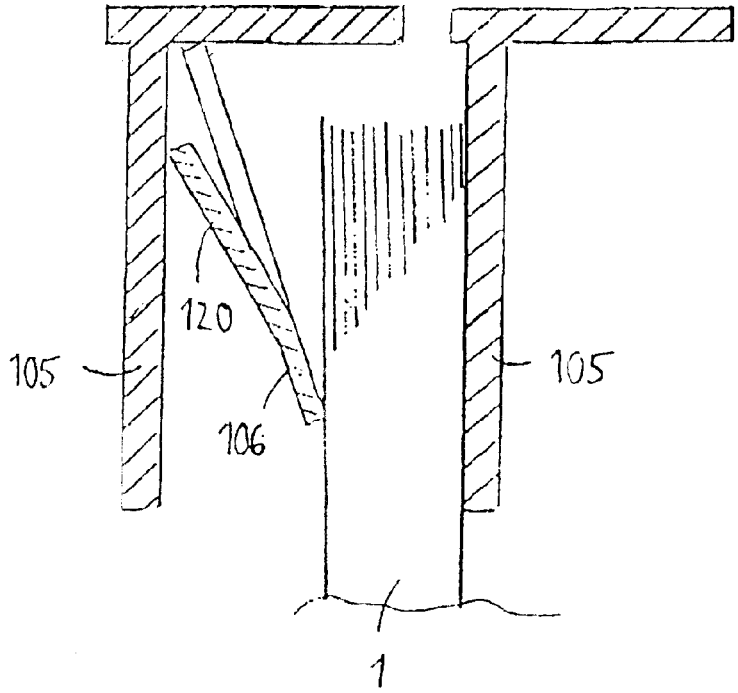

CONVEYOR AND METHOD FOR MOVING BOOKLETS

FIELD OF INVENTION

The invention relates to a conveyor and to a method of conveying. The invention also relates to a booklet comprising a bundle of sheets, for instance paper sheets, and a casing or cover which encases a bundle. The term booklet also includes finished booklets, where the bundle of sheets is fastened to the casing, and also booklets where the bundle of sheets has not yet been secured to the casing.

DESCRIPTION OF THE BACKGROUND ART

There has long been known in the art a method of manufacturing booklets that comprise a bundle of sheets, for instance paper sheets, and a casing includes providing the casing with a spine and applying to the inner surface thereof a binding agent in the form of a deactivated glue. The bundle of sheets is inserted into the casing such as to bring one side edge of the bundle into abutment with the glue on the casing spine. The casing is normally comprised of cover sheets that form a front side and a back side which are connected to the spine, said front and back covers having essentially the same shape and size as the sheets in said bundle. The casing may also be made of paper, although it can, of course, be made of any other suitable material.

When the bundle is in place in the casing, the glue on the spine of the casing is activated so as to firmly glue the bundle to the spine, along one of the side edges of said bundle. This can be achieved, for instance, by initially applying the glue in a solid state and then heating the glue so as to bring it to a liquid or semisolid state. In this regard, one side edge of each sheet in the bundle is in contact with the glue. The glue is then allowed to cool to a solid state, therewith fastening the bundle of sheets to the spine of the casing.

When a large number of booklets are to be produced, it is known to automate the whole of the manufacturing process or parts thereof. Thus, apparatus are known by means of which manufacture can be automated. It is known to use in such arrangements or plants conveyors that transport a casing to a gluing station from a compilation station in which a sheet bundle is inserted into said casing. In this known arrangement, the gluing station includes a conveyor by means of which a plurality of booklets are moved singly and sequentially in a transportation direction that is generally perpendicular to the plane of each booklet. The booklets are therewith moved over a glue-activating unit, where the spine of each booklet is moved in the close proximity of a heating element, so as to melt the glue. In the case of this known arrangement in which the sheet bundle rests with one of its side edges against the spine of the casing, the side edges penetrate slightly into the glue as a result of the gravitational force acting on the bundle. Each booklet is then allowed to cool, so as to unite said bundle with the casing and therewith obtain a finished booklet.

The known conveyor includes two dogging devices, each having a plurality of dogging yokes. The conveyor-carried dogging yokes are moved along the glue-activating unit in the transporting direction. Each booklet arriving at the glue-activating unit is positioned with a pair of dogging yokes on each dogging device straddling two mutually opposing side edges of the booklet. In order to enable the booklet to be inserted between the two pairs of dogging yokes, the latter are spaced apart at a distance which is greater than the thickness of the booklet, so that straddling can take place with a relatively large clearance in the transport direction. Because the arrangement shall be able to deal with booklets of mutually different thicknesses, the distance between mutually adjacent dogging yokes is adapted so that the clearance provided will be sufficient to accommodate booklets of relatively large thickness. The clearance can therefore be relatively large in respect of the manufacture of thinner booklets. This is necessary in order to be able to place a booklet readily and securely in conveyors, particularly when it is automated as in the case of the known arrangement. A booklet manufacturing apparatus of this kind is described in WO91/04159, for instance.

SUMMARY OF THE INVENTION

Although an arrangement of this earlier known kind has been found effective in the manufacture of booklets, it has been found that said necessary clearance has a number of drawbacks from certain aspects. This particularly applies when the booklets to be manufactured are relatively thin. In the case of dogging yokes that are spaced apart at a distance of 20 mm, the distance between two mutually adjacent dogging yokes will be about 16 mm when taking into account the inherent thickness of respective dogging yokes. This clearance will be rather high in the case of booklets whose thickness is less than 12 mm. Consequently, when the booklet has been placed with two mutually opposing side edges between a pair of dogging yokes on each dogging device, the booklet will tend to slope towards the front or rear dogging yoke in each pair. The booklet will therefore be curved in an arc between the dogging yokes. In conjunction with activating the glue, it is normally necessary to jog the sheets in the bundle initially from above, so as to ensure that all sheets will be properly glued. This jogging is made difficult by the fact that the booklet is arched between the dogging yokes, since the booklet will spring when jogged. This can make it difficult to fasten the outermost sheets in the bundle properly in the glue. It will also result in the formation of an angle between the bundle and the spine of the casing when the glue has solidified.

Against this background, the object of the present invention is to provide a conveyor in which booklets can be transported without risk of becoming slanted.

According to a first aspect of the invention, this object is achieved with a conveyor of the kind defined in the preamble of claim 1 and having the particular features set forth in the characterising clause of said claim. Because support elements are arranged in the space between two dogging yokes, it is ensured that the booklet will be straightened as it is straddled and be generally straight in a plane perpendicular to the movement direction.

Because the support element is resilient (springy) an appropriately chosen pressing force from the support element can be obtained in a simple fashion. Moreover, the conveyor can be adapted to handle booklets of mutually different thicknesses in a purposeful manner.

Moreover, because the resilient element is adapted to be supported against one of the two dogging yokes, there is obtained a simple and purposeful arrangement for achieving said resilience or spring action. In this respect, the support element is conveniently affixed to the dogging yoke, which constitutes a preferred, further embodiment.

The side edges of a booklet are straddled by the dogging yokes. It will be noted, however, that in some cases, when the booklets are thin, a number of booklets may be straddled by a pair of dogging yokes at one and the same time. The term booklet as used in the claims shall therefore be interpreted as also including a bunch of several booklets.

Although the invention finds its origin in providing a solution to a problem that occurs at a specific tempo in the booklet manufacturing process, its application is not restricted to this problem. An inventive conveyor thus includes applications other than the application concerned with booklets moving over a glue-activating device.

According to another preferred embodiment of the invention, an activator is provided for activating the support element subsequent to said mutually adjacent dogging yokes having straddled one side edge of a booklet. Because the support element is arranged not to be activated until this stage is reached, it will not hinder positioning of the booklet between the dogging yokes.

According to a further preferred embodiment of the invention, the activating device for activating a respective support element is arranged to activate said element when it is located in a predetermined position in the direction of transportation. This provides a practical manner of automatically bringing the support element to an active state.

According to a further preferred embodiment, each support element is adapted to act along essentially the whole of respective side edges. This increases the certainty of correct orientation of the booklets, i.e. in positioning the booklets flat in a plane perpendicular to the direction of transportation.

In a further preferred embodiment, the support element has the form of an elongate, generally flat strip that includes one or more tongues which project out from the plane of the strip and which form the resilient or springy elements and which are angled to the plane of the strip in the absence of load. Because the angled tongues are supported resiliently, or springingly, against the dogging yoke, there is obtained a very simple way of spring-loading the support element.

According to a preferred embodiment, each tongue is made in a piece integral with the strip and of the same material as said strip. The spring-loaded support element can therewith be produced very easily and inexpensively.

According to a further preferred embodiment, the tongues can be bent in towards the plane of the strip, wherewith, when the support element is deactivated, the tongues will be situated essentially in the plane of the strip. The spring element will therewith require the minimum of space.

According to a further preferred embodiment, the support element is affixed to the adjacent dogging yoke with the aid of hinge means. The support element can therewith readily be activated and caused to lie in abutment with the booklet.

According to a further preferred embodiment, the support element, when in a deactivated state, is adapted to lie tightly adjacent and parallel with the adjacent dogging yoke, and, in an activated state, to define an angle with said dogging yoke, wherewith the resilient element is adapted to exert a force that increases said angle. This results in an arrangement in which simplicity, reliability and a small space requirement for functioning of the support element are united in an optimal fashion. An effective clamping effect is obtained between the support element and the dogging yoke situated on the opposite side of the booklet.

According to a further preferred embodiment of the inventive conveyor, said conveyor includes two dogging devices. Each dogging device acts on a respective opposite side edge of the booklet. Movement of the booklet in this way, with a dogging yoke at each end edge results in safer and more stable transportation.

The other dogging device will also suitably include support elements of one of the preferred kinds, so as to ensure that the booklets will be properly aligned, in an optimal fashion.

The second or other dogging device will conveniently be identical to the first dogging device, therewith increasing safety and keeping down manufacturing costs.

According to a further preferred embodiment, the conveyor is adapted to move booklets that consist of a sheet bundle and a casing, said sheet bundle not being affixed to the casing prior to transportation, wherein, during transportation, a glue-activating device, preferably a heating device, functions to activate a glue applied to the casing, so as to affix the sheet bundle to the casing. Although an inventive conveyor can be used purposefully in various connections when booklets shall be transported, it is primarily with an application according to this embodiment that the advantages afforded by the conveyor become especially valuable, since it is here of great significance to the end result that the booklets are not curved or angled as they are transported.

The advantages afforded by a conveyor that also includes a sheet jogging device are also especially valuable. This is because jogging is facilitated when the booklets are flat, as they do not spring when in this state. Consequently, this constitutes a further preferred embodiment of the inventive conveyor.

The aforesaid advantageous embodiments of the inventive conveyor will be apparent.

By firmly clamping each booklet between a pair of dogging yokes in accordance with the method, the document is orientated in a manner corresponding to that described above with respect to the inventive conveyor.

Advantageous embodiments of the inventive method will be apparent. The advantages gained by these advantageous embodiments of the inventive method correspond to those advantages described above with respect to advantageous embodiments of the inventive conveyor.

The invention will now be described in more detail with reference to preferred embodiments thereof and also with reference to the accompanying drawings.

BRIEF DESCRIPTION OF THE DRAWINGS

FIG. 1 is a partially cut-away perspective view of a casing with an inserted, but not yet affixed, sheet bundle.

FIG. 2 is a section view taken on the line II—II in FIG. 1.

FIG. 4 is a side view of the machine in FIG. 3, as seen from the right.

FIG. 16 is a horizontal sectioned view of a pair of dogging yokes and the side edges of a booklet with the support element deactivated.

FIG. 17 is a sectioned view corresponding to FIG. 16, with the support element activated.

DESCRIPTION OF PREFERRED EMBODIMENTS

Figure 3:
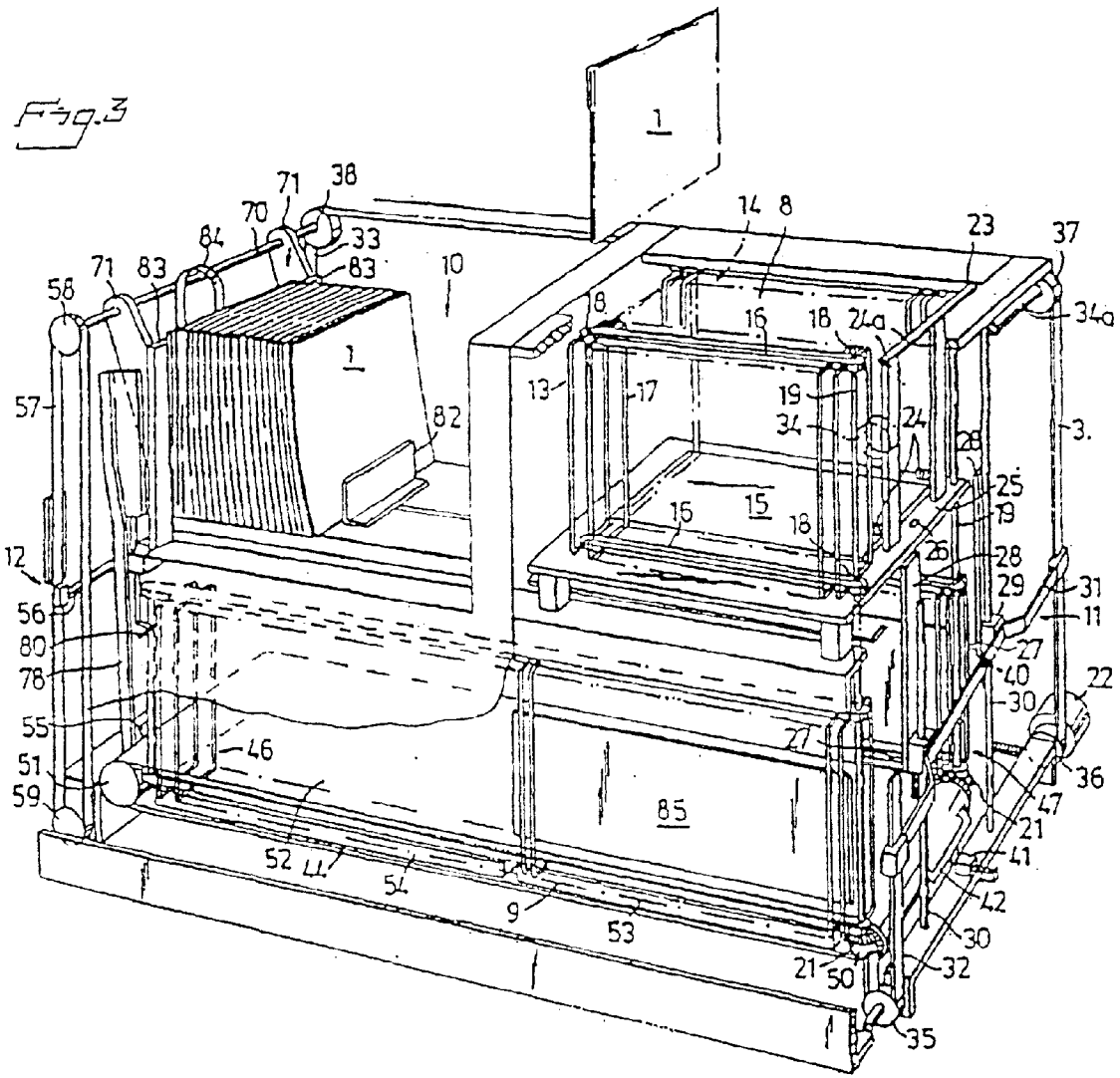
FIG. 3 is a partially cut-away perspective view of a machine for binding sheet bundles in casings of the type of booklet shown in FIGS. 1 and 2.

Shown in FIG. 1 is a casing 1 that consists of paperboard and/or plastic and which has been folded from a flat state to the shape shown in FIG. 1, so as to form two casing sides 2 and 3 and a spine 4. An adhesive 5 is applied to the inner surface of the spine 4 and possibly also to those parts of the casing sides 2 and 3 that lie close to the spine. The adhesive 5 may have different forms and compositions, although it will preferably consist of a strip of hotmelt glue of essentially rectangular cross-section, i.e. a glue which takes a solid state at room temperature and a semi-solid state or liquid state when heated to a higher temperature.

A sheet bundle 4 consisting of a plurality of paper sheets is shown to be inserted into the casing in FIGS. 1 and 2, such that one side edge of respective sheets in said bundle rests against the surface of the binder 5 distal from said spine. The casing and its inserted sheet bundle are intended to be fed into the machine illustrated in FIGS. 3–5 and treated in this state., so as to affix the bundle to the casing through the medium of the binder 5.

Figure 5:
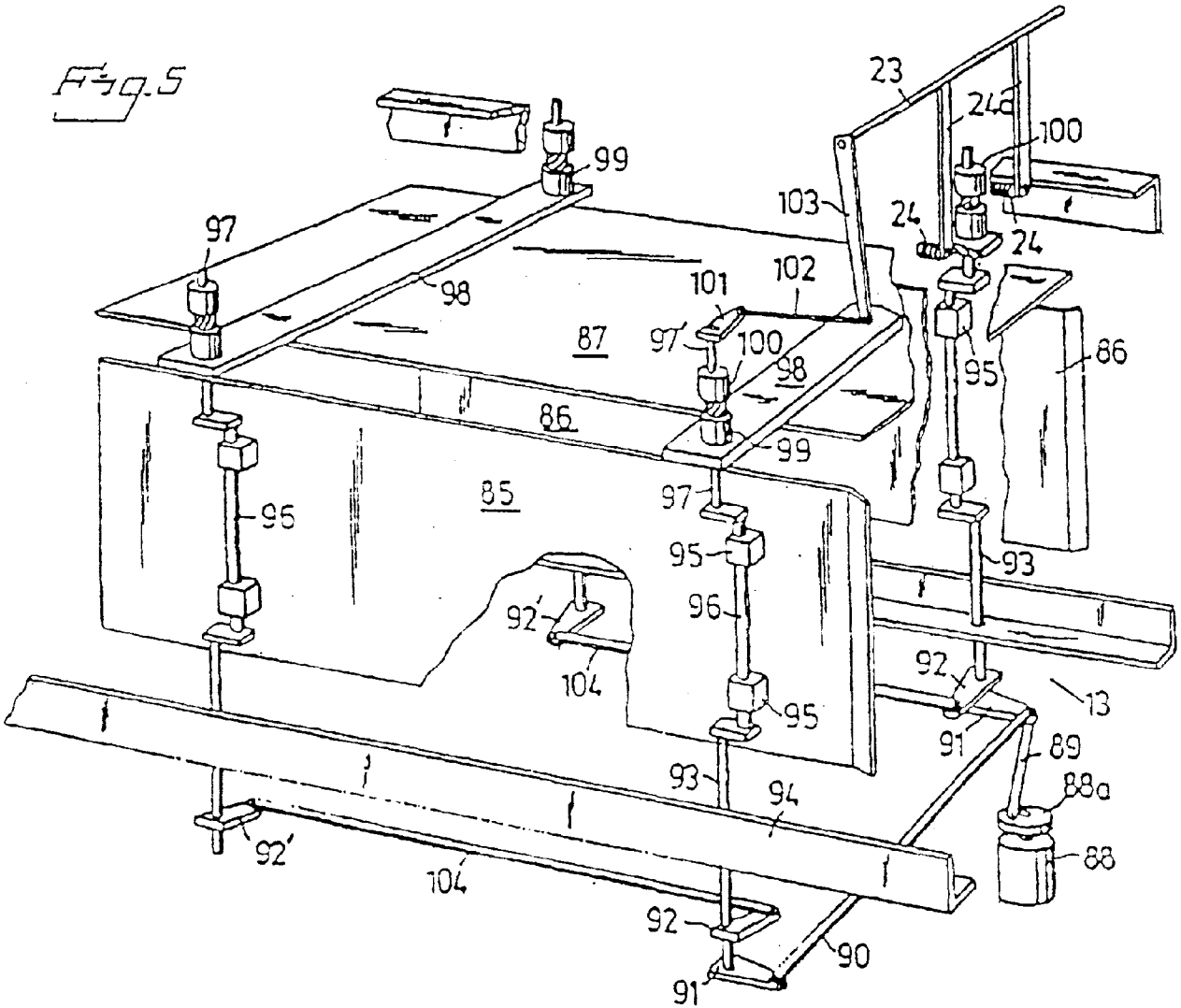
FIG. 5 is a schematic perspective view of a sheet jogging device included in the machine according to FIG. 3 and FIG. 4, among other things.

The machine illustrated in FIGS. 3–5 is intended for the production of booklets, each being of the kind that consists of a casing 1 and a sheet bundle 6 inserted into said casing in the manner shown in FIGS. 1 and 2. The sheet bundle 6 need not be jogged upon insertion into the machine, and neither need it be orientated in the finely desired position in the casing. FIG. 1 shows this state.

The main components of the machine include a magazine 8, in which the casings 1 and inserted sheet bundle 6 are placed, an activator 9 for heating and possibly later cooling the binder 5, and a collecting space 10 for collecting finished booklets. The machine also includes devices for conveying the casings and their inserted sheet bundles from the magazine 8 to the collecting space 10, and a sheet jogging device (FIG. 5). In order to make the machine as compact as possible and to facilitate placement of the casings and sheets in the machine and the removal of finished booklets from said machine, the magazine 8 and the collecting space 10 have been placed immediately by the side of each other and immediately above said activating device 9.

The magazine 8 is delimited by a parallelepipedic space that contains a conveyor which comprises two mutually identical and parallel dogging devices 13 and 14 which delimit two side walls of said space, and a bottom plate 15 affixed to the machine frame. Each dogging device 13, 14 comprises two endless and flexible toothed belts 16, and wire yokes 17 attached to the belts and extending therebetween. The belts 16 are driven by toothed wheels 18, of which both of the toothed wheels of each conveyor 13, 14 are driven by a shaft 19, said two toothed wheels being seen furthest to the right in FIG. 3. The shafts 19 are continuously rotated in one direction by an electric motor 20, via co-acting conical gearwheels or pinion wheels 21*a* and 21*b*.

Each dogging device 13, 14 includes two mutually adjacent yokes 17 spaced apart at a distance that exceeds the maximum occurring thickness of a casing 1 and its inserted sheet bundle 6, said adjacent yokes 17 forming a compartment. This means that two or more casings and their respective sheet bundles of the minimum occurring thickness will be accommodated between these two yokes. Each casing 1 and its inserted sheet bundle 6 are placed down in the magazine 8 between a pair of mutually adjacent yokes 17 in each dogging device 13, 14, with the spine 4 facing downwards and positioned horizontally, and will be supported by and dogged by said yokes as the mutually facing parts of the conveyors are moved synchronously to the right in FIG. 3 with the spines 4 of said casings 9 against the plate 15.

Two arms 24*a* are attached to a horizontal shaft 23 immediately to the right of the conveyors 13 and 14. These arms 24*a* can be swung backwards and forwards by means that will be described below with reference to FIG. 5. A suction cup 24 is mounted on the free end of each arm 23.

When a casing 1 and its inserted sheet bundle 6 has been moved so far to the right in the magazine as to leave the plate 15, it will fall down through a short distance into abutment with a plate 25 that forms a part of the machine frame. In so doing, the spine 4 of the casing actuates a switch 26 which briefly stops the movement of the conveyors 13, 14 and which sends an impulse to a suction pump (not shown) connected to the suction cups 24, causing said suction pump to work. Concurrently herewith, the swinging shaft 23 moves the suction cups 24 onto the casing resting on the plate 24, therewith securely gripping the casing by suction. When the shaft 23 is then swung in the opposite direction, the suction cups 24 move the casing 1 and its sheet bundle 6 to the right in FIG. 3, wherewith the casing leaves the plate 25. When the suction cups 24 then release their grip on the casing 1, the spine 4 of the casing will come into abutment with two stops 27 on a hoist that consists of two arms 28 provided with blocks 29 that are intended to run vertically on rods 30 mounted in the machine frame and extending along practically the full height of the machine. The two arms 28 and the blocks 29 are mutually connected by means of an angled arm 31 whose ends are attached at two flexible toothed belts 32 and 33 which are driven by a motor 22 that has a reciprocatingly rotating outward shaft, via shafts driven thereby, such as the shafts 34*a* and 34*b* and toothed wheels. The toothed belt 32 extends between toothed wheels 34 and 35, while the toothed belt 33 extends between toothed wheels 36–39.

Immediately after the casing 1 and its inserted sheet bundle 6 has been transferred to the stops 27 on the hoist 28, 29, 31, where said casing is held vertically by the arms 28, the toothed belts 32 and 33 move the hoist down to the lower part of the machine.

As the hoist 28, 29, 31 reaches its bottom terminal position, the spine 4 of the casing 1 will come into contact with two frame-carried surfaces 43 which slope inwardly and downwardly. After sliding on the surfaces 43, the casing 1 will be pushed by the stop plate 42 onto the conveyor arrangement 44 and their gripped by dogging devices 46 and 47. These dogging devices are essentially identical to the dogging devices 13, 14 but with the exception that these latter devices have a longer horizontal extension. The dogging devices 46, 47 are mounted on shafts 60 that are driven step-wise by a motor 61 and in directions opposite to the dogging devices 13, 14. The motor 61 includes an eccentric disc 61*a* which swings a catch hook 63 backwards and forwards through the medium of an arm 62. The catch hook 63 engages with a catch wheel 64 which causes a shaft 65 connected there to, to to move stepwise in a counter-clockwise direction in FIG. 4. The shaft 65 drives the shaft 60 through the medium of conical pairs of toothed wheels 21 and a roller 50 extending therebetween.

The conveyor arrangement 44 includes at least one endless and flexible conveyor belt 52 made of some suitable heat-conducting material, such as Teflon® the upper part of which moves stepwise to the left in FIG. 3 with the same speed as the dogging devices 46 and 47. The conveyor arrangement 44 also includes the roller 50 and a roller 51 on which the belt 52 is mounted.

The activating device 9 is situated between the belt runs and projects sideways beyond said belt, where it is fastened to the machine frame. The device 9 includes a heating plate 53 which emits sufficient heat to melt, via the belt 52, the strip of hotmelt glue applied to the casing to a semi-solid or almost liquid state. The bottom run of the belt 52 abuts with and slides against the heating plate 53. If the binder is of a kind other than hotmelt glue, the construction of the activating device is adapted accordingly. In an alternative embodiment, the belt 52 may be constructed to constitute a heat source or some other binder activating means.

Mounted between both runs of the belt 52 to the left of the heating plate 53 in FIG. 3 is a cooling plate 54 against which the upper surface of the upper run of the belt abuts and slides. The degree of cooling afforded by the underside of the plate 54 can be enhanced by providing said plates with cooling fins and/or a cooling fan or blower can be installed in the machine. Alternatively, the plates 54 may be equipped with channels for cooling water.

The dogging devices 46 and 47 and the belt 52 that runs at the same speed as said devices move the casing 1 and its inserted sheet bundle 6 to the left. During this movement, the hotmelt glue is brought to a semi-solid or to an almost liquid state and the sheet bundle 6 falls down into the hotmelt glue towards the spine 4. As the casing 1 and its sheet bundle 6 move, the sheets in said bundle are jogged relative to the casing by a sheet jogging device. As the sheets are jogged, the casings and sheet bundles therein are forced in a direction towards the heating plate 53, such as to increase the transfer of heat from said plate to the spine 4 of the casing, via the belt 52.

The reason why the casings 1 are not in direct contact with the heating plate 53 during their movement over the plate, is because friction between the casings and plate could possibly score or dirty the outer surfaces of the casing spines 4, which is a risk particularly when the spines have colour printing thereon.

When the casing 1 and its inserted sheet bundle 6 has passed the heating plate 53, the casing and its contents is passed over the cooling plate 54, still by the dogging devices 46, 47 and the belt 52, wherewith the hotmelt glue is brought at least to a partially solid state. When the casing has passed the plate 54, the glue will have taken a substantially solid state.

When the casing 1 and the sheet bundle 6 bound therein, i.e. the finished booklet, has passed the conveyor arrangement 44, the booklet will fall down into a chute 55 at the left end of the arrangement 44. The booklet is conveyed from the chute 55 to the collecting space 10 by the conveyor arrangement 12.

Subsequent to the booklet having arrived in the space 10, the hoist, i.e. the arrangement 12, is lowered to collect a further booklet lying in the chute 55.

FIG. 5 shows the sheet jogging device 13, which includes three plates 85, 86 and 87 and drive means therefor, as indicated in FIG. 4, of which plates at least the plate 85 is shown in FIG. 3. A motor 88, which may be the same motor as that referenced 61, is provided with an eccentric disc 88*a* on which there is pivotally mounted an arm 89. The arm 89 is pivotally connected to an arm 90 which is pivotally connected to pivot elements 91 fixedly connected to the pivot elements 92 and shafts 93, which are pivotally mounted in beams 94 on the machine frame. Pivot elements 92 identical to the pivot elements 92 are pivotally connected there to, to by means of arms 104.

The shafts 93 are provided with cranks 96 mounted in blocks 95 affixed to the plates 85–87. The upper part of each crank 96 is fastened in a shaft 97 which extends through a beam 98 affixed to the plate 87. Each shaft 97 is connected above the beams 98 with a screw 100 that engages with a nut 99 affixed to the upper side of said beam 98. The nut 99 is non-rotatably attached to the machine frame, but can be displaced axially in relation thereto.

As the motor 88 rotates, the plates 85 and 86 move towards and away from each other in a horizontal direction at a frequency determined by the speed of the motor.

The plates will move concurrently in a direction towards and away from the activating device 9, owing to the fact that the axially immovable screws 100 will be screwed into and out of the nuts 99 as the shafts 97 rotate, so as to move the nuts axially and therewith carry the beams 98 and the plate 87. Movement of the plates 85–87 takes place immediately prior to and during activation of the binder 5 in the casings 1 by the activating device 9, partly to jog the sheets 6 relative to one another and relative to the casings and partly to urge the casings and their sheets against the activating device 9 (which only the plate 87 does) so as to increase the transfer of heat to the binder.

One of the shafts 97, which is extended and referenced 97*b*, includes a pivot element 101 that is pivotally mounted in a rod 102, which is pivotally mounted in an arm 103 attached to one end of the shaft 23. As the shaft 97 rotates forwards and backwards, the shaft 23 is swung alternately in a clockwise and counter-clockwise direction, so as to move the suction cups 24 towards and away from a casing 1 resting on the plate 25.

Figure 6:
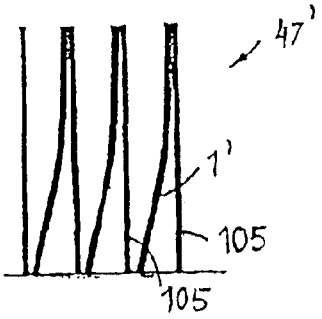
Fig. 6 PRIOR ART
FIG. 6 is an elemental illustration of the position of the booklets in a conventional conveyor, seen in side view.

Up to this point, the described machine for the production of booklets corresponds to the machine described in the earlier mentioned publication WO91/04159 and is thus known to the art. Hereinafter, there is described a specific design of the conveyor 44 that is constructed to move the booklets over the glue-activating device 9, this design being in accordance with the present invention. In order to facilitate an understanding of the invention, reference is first made to FIG. 6 which illustrates schematically how the booklets are disposed in a conveyor of conventional construction. The figure is a vertical sectioned view taken longitudinally through a part of the dogging devices 47' of the conveyor, said section being lain adjacent one side edge of each booklet 1'. One side edge of each booklet 1' is located between two adjacent dogging yokes 105' of the dogging device 47'. The distance between two dogging yokes 105' is greater than the thickness of each booklet 1'. As a result, the booklets 1' will curve between the dogging yokes 105', as evident from the figure. The drawbacks in this case have been discussed in the introduction to the description.

Figure 7:
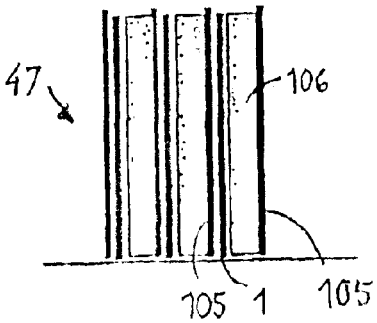
FIG. 7 is an illustration of an inventive conveyor, corresponding to FIG. 6.

FIG. 7 is a corresponding view illustrating a dogging device constructed in accordance with the invention. A support element 106 is attached at each dogging yoke 105 in a manner described in more detail hereinafter. Each support element 106 clamps respective booklets against the preceding or succeeding dogging yoke 105, so that the booklet will be orientated in a flat, vertical position.

Figure 8:
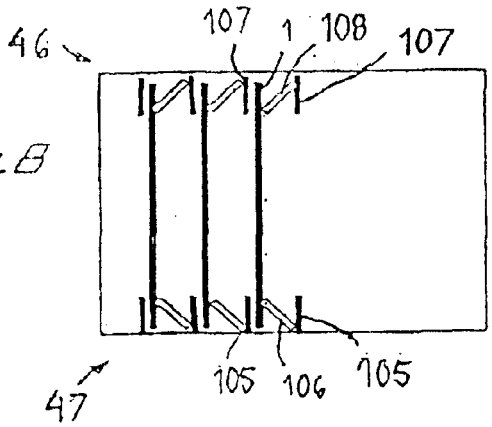
FIG. 8 illustrates the conveyor of FIG. 7 from above.

FIG. 8 is a view of the arrangement shown in FIG. 7 from above. FIG. 8 also shows how the opposing end edges of each booklet 1 are clamped between dogging yokes 107 and associated support elements 108 of a second dogging device 46 situated centrally opposite the first dogging device 47.

Figure 9:
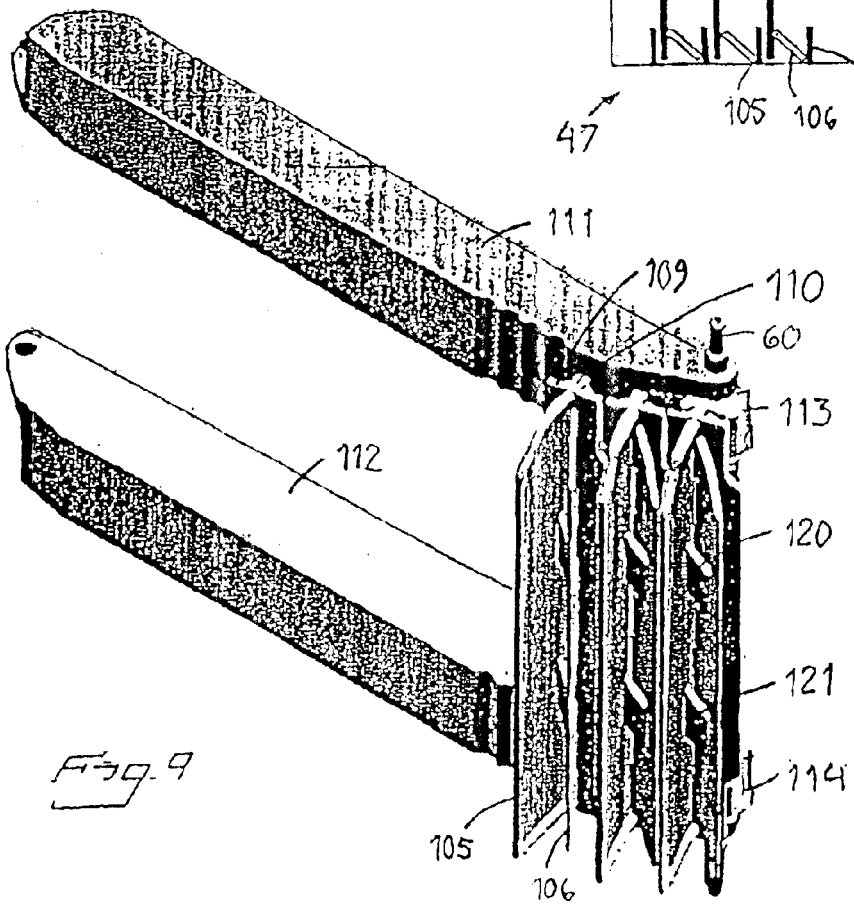
FIG. 9 is a perspective view of part of a dogging device according to the invention.

FIG. 9 is a perspective view of part of the dogging device 47 shown in FIG. 7. Each dogging yoke 105 has the form of an elongated, flat plate which has at its inner end a collar 109 that extends perpendicular to the plate. Each dogging yoke 105 has at its top and bottom inwardly of the collar 109 a projection 110 which slides against a respective guide body 111, 112 as the dogging yoke 105 moves. The dogging yokes 105 are disposed sequentially in an endless belt that is driven by a shaft 60 via top and bottom toothed drive bodies 113, 114. Each drive body 113, 114 engages a respective projection 110 on the dogging yoke. It will be seen from the figure that a support element 106 is arranged at each dogging yoke 105.

Figure 10:
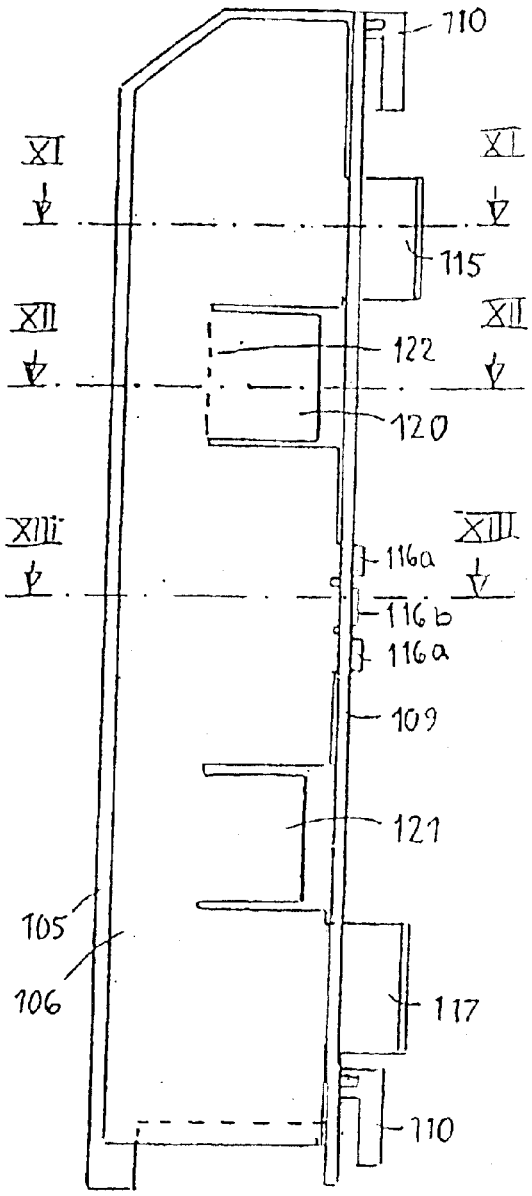
FIG. 10 is a side view of a dogging yoke that includes support elements in accordance with the invention.
Figure 11:
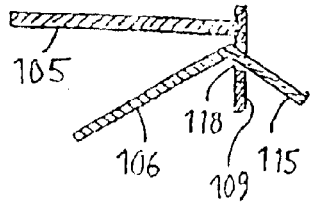
FIG. 11 is a sectional view taken on the line XI—XI in FIG. 10.
Figure 12:
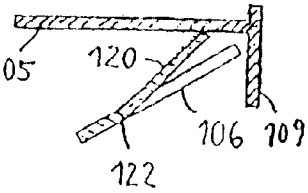
FIG. 12 is a sectional view taken on the line XII—XII in FIG. 10.
Figure 13:
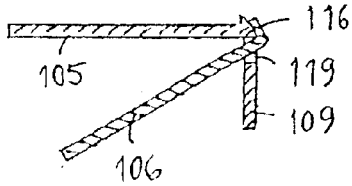
FIG. 13 is a sectional view taken on the line XIII—XIII in FIG. 10.

FIG. 10 shows a dogging yoke 105 and a support element 106 attached thereto. FIGS. 11, 12, 13 are sectioned views through the dogging yoke of FIG. 10, taken on the lines XI—XI, XII—XII and XIII—XIII respectively. The dogging yoke 105 has the form of an elongate, generally rectangular plate, and the support element 106 has essentially the same size and shape. In the figure, the support element 106 is situated in front of the dogging yoke 105, this latter thus being substantially hidden from view. The collar 109 of the dogging yoke 105 Is arranged to the right of the figure (see FIG. 11). The support element 106 is fastened to the dogging yoke 105 in a hinge-like manner, by virtue of three tabs 115, 116 and 117 on the support element 106 extending through respective slots 118 and 119 in the collar 109 of said dogging yoke (see FIGS. 11 and 13). The two outermost tabs 115 and 117 define with the main body of the support element 106 an angle that is slightly greater than 90°. These two tabs 115, 117 are relatively long and contribute towards activating/deactivating the support element. The centre tab 116 is divided into three parts 116*a*, 116*a*, 116*b*. The two outer tabs 116*a*, 116*a* extend straight through the slot 119, whereas the centre tab 116*b* is angled at about 90° in the opposite direction compared to the tabs 115, 117 (see FIG. 13). The tab parts 116*a*, 116*a*, 116*b* are intended primarily for contributing towards and holding the support element attached to the dogging yoke. Furthest out at each end of the dogging yoke 105 are the two projections 110 by means of which the dogging yoke is caused to move.

The support element 106 also includes two tongues 120 and 121 formed by making slots in the material of the support element. The manner in which these tongues 120 are formed will be more apparent from FIG. 12. The tongue 120 is bent out from the remainder of the plane of the support element and there defines an angle to said plane when no load acts thereon. The material from which the dogging yoke is made and the thickness of said material are chosen so as to enable the tongue 120 to be folded down towards the plane of the dogging yoke 106, about the bending line 122. The resistance to bending will therewith exert a counterforce that induces a spring effect.

Figure 14:
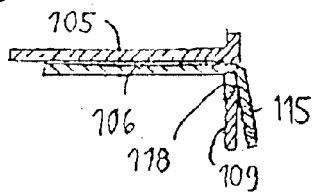
FIG. 14 is a sectional view corresponding to FIG. 11, with the support element deactivated.

The resilient tongues 120, 121 of the support element shown in FIGS. 10–13 are in a relaxed or non-loaded state. The resilient tongues 120, 121 are subjected to load, by bending the tabs 115, 117 downwards/inwards against the collar 109 of the dogging yoke. FIG. 14 is a sectioned view corresponding to FIG. 11 and shows how the support element 106 takes a position parallel with and adjacent to the dogging yoke 105 subsequent to the tab 115 having been folded down. This takes place whilst overcoming the flexural resistance of the resilient, or springy, tongues 120, 121. These tongues will then take the position illustrated in FIG. 15, said figure being a sectioned view corresponding to the view in FIG. 12.

Figure 15:
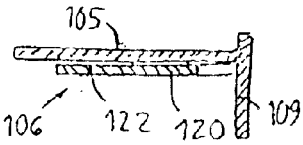
FIG. 15 is a sectional view corresponding to FIG. 12, with the support element deactivated.

The support element 106 is therewith deactivated in the position shown in FIG. 15. The support element 106 is in an activated state in FIG. 12.

In the deactivated state of the support element, one side edge of a booklet 1 can be inserted with clearance between two mutually adjacent dogging yokes 105, as illustrated in FIG. 16. In this illustration, the support element 106 is locked in its position adjacent the dogging yoke 105, by virtue of the tabs 115, 117 being locked in the position illustrated in FIG. 14.

Correspondingly, FIG. 17 shows the case when the support element 106 is activated by releasing the lock on the tabs 115, 117. The tongues 120, 121 then strive to press the support element 106 out towards the position illustrated in FIG. 12. As will be evident from FIG. 17, movement of the booklet 1 is stopped and the booklet therewith clamped between the support element 106 and the opposing dogging yoke 105 and is pressed against the latter by the springy tongues 120, 121.

Locking of the tabs 115, 117 takes place at the beginning of the movement of a dogging yoke 105 in the transport direction. This takes place by virtue of ridge means (not shown) arranged on the support bodies 111, 112 at their commencement on a level corresponding to the level of the tabs. The ridge elements thus urge the tabs into the position shown in FIG. 14, therewith creating the clearance shown in FIG. 16. After a short time, the tabs 115, 117 will have passed the ridge elements and go free so that the resilient tongues 120, 121 will be activated, as in FIG. 17. Clamping of the booklets is released in the final stage of transportation, by virtue of the dogging yokes deviating from the direction of transport as they move around the end of respective support bodies 111, 112 located where transportation terminates.

The dogging yokes 105 and the support devices may conveniently be made of a plastic material.

What is claimed is:

1. A conveyor that comprises at least one dogging device that includes a plurality of dogging yokes which are arranged to jointly move in a transporting direction in mutually spaced and sequential relationship, wherein the conveyor is adapted to move booklets in said transport direction with the aid of a pair of mutually adjacent dogging yokes that are arranged to straddle, with clearance, a side edge of a booklet in the transport direction, including a support device which bridges said clearance at least partially and which acts between two mutually adjacent dogging yokes when one side edges of a booklet is straddled by said mutually adjacent dogging yokes, characterized in that the support device includes springy elements that are adapted to take support against one of said two dogging yokes.

2. A conveyor according to claim 1, characterized by an activating device which is adapted to activate the support device subsequent to one side edge of a booklet having been straddled by said adjacent dogging yokes.

3. A conveyor according to claim 2, characterized in that the activating device is arranged to activate the support device when said support device is situated in a first predetermined position in the transport direction.

4. A conveyor according to claim 1, characterized in that the support device is arranged to act along substantially the whole of said side edge.

5. A conveyor according to claim 1, characterized in that the support device is affixed to said one dogging yoke.

6. A conveyor according to claim 5, characterized in that the support device has the form of an elongate, essentially flat strip that includes at least one tongue which projects out from the plane of the strip and which forms said springy element and which defines an angle with the plane of the strip in a non-loaded state.

7. A conveyor according to claim 6, characterized in that said at least one tongue is an integral part of the strip and is comprised of the same material as said strip.

8. A conveyor according to claim 7, characterized in that the tongue can be bent in towards the plane of the strip, and in that the tongue is intended to lie essentially in the plane of the strip when the support device is deactivated.

9. A conveyor according to claim 5, characterized in that the support device is affixed to said one dogging yoke with the aid of hinge elements.

10. A conveyor according to claim 9, characterized in that when in a deactivated state, said support device is intended to lie closely adjacent to and parallel with said one dogging yoke, and when in an activated state is intended to define an angle with said dogging yoke, wherein said springy element functions to exert a force that increases said angle.

11. A conveyor according to claim 1, characterized in that a second dogging device is adapted to act on a booklet side edge opposite to said one side edge.

12. A conveyor according to claim 10, characterized in that said second dogging device includes additional support devices constructed as in said support device.

13. A conveyor according to claim 12, characterized in that the first and the second dogging devices are essentially of identical designs.

14. A conveyor according to claim 1, characterized in that the conveyor is constructed to move booklets that consist of a bundle of sheets and a casing, wherein the sheet bundle is not secured to the casing prior to said movement, and wherein a glue activating device arranged to heat the glue is adapted to activate during transportation glue applied to the casing so as to affix the sheet bundle to the casing.

15. A conveyor according to claim 14, characterized by a jogging device adapted for jogging the sheet bundle during their movement.

16. A method for moving booklets in a transporting direction with the aid of a conveyor, comprising the steps of straddling one side edge of a booklet with clearance in said transporting direction by a pair of dogging yokes that are located adjacent one another, jointly moving said dogging yokes in said transporting direction in mutually spaced and sequential relationship, employing a support device to at least partially bridge said clearance, and applying a spring force against the booklet, said spring force being biased by an adjacent dogging yoke, whereby said clearance is caused to be eliminated subsequent to straddling of the booklet.

* * * * *